United States Patent [19]

Farrier et al.

[11] Patent Number: 5,020,548

[45] Date of Patent: Jun. 4, 1991

[54] SMOKING ARTICLE WITH IMPROVED FUEL ELEMENT

[75] Inventors: Ernest G. Farrier, Winston-Salem; James L. Harris, Westfield; Alan B. Norman, Clemmons; James L. Resce, Yadkinville; Andrew J. Sensabaugh, Jr.; Michael D. Shannon, both of Winston-Salem, all of

[73] Assignee: R. J. Reynolds Tobacco Company, Winston-Salem, N.C.

[21] Appl. No.: 769,532

[22] Filed: Aug. 26, 1985

[51] Int. Cl.[5] ..... A24D 1/00; A24D 1/02; A24D 1/18; A24F 1/00

[52] U.S. Cl. ..... 131/194; 131/335; 131/360; 131/361; 131/364; 128/202.21

[58] Field of Search ..... 131/194, 335, 360, 361, 131/364; 128/202.21

[56] References Cited

U.S. PATENT DOCUMENTS

| | | |
|---|---|---|
| R. 27,214 | 11/1971 | Nakahara . |
| 29,436 | 7/1860 | Lindsley . |
| 198,075 | 12/1877 | Brisbane . |
| 235,886 | 12/1880 | Lindsley . |
| 261,056 | 7/1882 | Smith . |

(List continued on next page.)

FOREIGN PATENT DOCUMENTS

| | | |
|---|---|---|
| 276250 | 7/1965 | Australia . |
| 117355 | 12/1983 | European Pat. Off. . |
| 1294351 | 9/1975 | Fed. Rep. of Germany . |
| 370692 | 2/1907 | France . |
| 998556 | 1/1952 | France . |
| 1264962 | 5/1961 | France . |
| 2033749 | 4/1970 | France . |
| 2057421 | 5/1971 | France . |
| 2057422 | 5/1971 | France . |
| 35-9894 | 5/1960 | Japan . |
| 275420 | 8/1951 | Switzerland . |
| 956544 | 4/1964 | United Kingdom . |
| 1185887 | 6/1967 | United Kingdom . |
| 1431045 | 4/1972 | United Kingdom . |
| 1597106 | 9/1981 | United Kingdom . |

OTHER PUBLICATIONS

M. L. Reynolds, "Infuence of Filter Additives on Smoke Composition," Rec. Adv. Tob., Sci., 4:47 (1978).

L. L. Lyerly, "Direct Vapor Chromotographic Determination of * * * Triacetin in Cigarette Smoke," Tob., Sci. 11:49 (1967).

J. E. Kiefer, "Factors that Affect Elution of Plasticizer from Cigarette Filters", Eastman Kodak Pub. No. FTR-65 (1981).

(List continued on next page.)

*Primary Examiner*—V. Millin

*Attorney, Agent, or Firm*—Grover M. Myers; David G. Conlin

[57] ABSTRACT

The present invention preferably relates to a smoking article which is capable of producing substantial quantities of aerosol, both initially and over the useful life of the product, without significant thermal degradation of the aerosol former and without the presence of substantial pyrolysis or incomplete combustion products of sidestream aerosol. The article of the present invention is able to provide the user with the sensations and benefits of cigarette smoking without the substantial combustion products produced by burning tobacco in a conventional cigarette. In addition, the article may be made virtually ashless so that the user does not have to remove any ash during use.

Preferred embodiments of the present smoking article comprise a short combustible carbonaceous fuel element, preferably less than 30 mm in length prior to smoking and less than about 8 mm in diameter a short, heat stable, preferably carbonaceous substrate bearing an aerosol forming substance, an efficient insulating means, and a relatively long mouthend piece. The fuel element is provided with a plurality of longitudinally extending passageways which act to control the heat transferred from the burning fuel element to the aerosol generating means.

40 Claims, 3 Drawing Sheets

U.S. PATENT DOCUMENTS

| | | | |
|---|---|---|---|
| 439,004 | 10/1890 | Harris . | |
| 1,259,181 | 3/1925 | Holmes . | |
| 1,581,619 | 4/1926 | Sulzberger . | |
| 1,770,616 | 7/1930 | Kean . | |
| 1,879,128 | 9/1932 | Desper . | |
| 2,020,646 | 11/1935 | Hornstein . | |
| 2,098,619 | 11/1937 | Finnell . | |
| 2,471,116 | 5/1949 | Newberger . | |
| 2,890,704 | 6/1959 | Lamm . | |
| 2,907,686 | 10/1959 | Siegel . | |
| 2,998,012 | 8/1961 | Lamm . | |
| 3,106,210 | 10/1963 | Reynolds . | |
| 3,220,418 | 11/1963 | Cohn . | |
| 3,223,090 | 12/1963 | Strubel . | |
| 3,258,015 | 6/1965 | Ellis . | |
| 3,356,094 | 12/1967 | Ellis . | |
| 3,516,417 | 6/1970 | Moses . | |
| 3,540,456 | 11/1970 | McGlumphy | 131/365 |
| 3,586,005 | 6/1971 | Lippman . | |
| 3,710,805 | 6/1972 | Tamaki . | |
| 3,738,374 | 6/1973 | Bennett . | |
| 3,863,644 | 2/1975 | Hunt . | |
| 3,886,954 | 6/1975 | Hannema . | |
| 3,943,941 | 3/1976 | Boyd . | |
| 4,044,777 | 8/1977 | Boyd . | |
| 4,061,147 | 12/1977 | Falchi . | |
| 4,079,742 | 3/1978 | Rainer . | |
| 4,219,032 | 8/1980 | Tabatznik . | |
| 4,284,089 | 8/1980 | Ray . | |
| 4,286,604 | 9/1981 | Ehretsmann . | |
| 4,297,139 | 6/1980 | Beall . | |
| 4,326,544 | 4/1982 | Hardwick . | |
| 4,340,072 | 7/1982 | Bolt . | |
| 4,391,285 | 7/1983 | Burnett . | |
| 4,407,308 | 10/1983 | Baker . | |
| 4,433,697 | 2/1984 | Cline . | |
| 4,437,855 | 9/1984 | Lanzillotti . | |
| 4,474,191 | 10/1984 | Steiner . | |
| 4,481,958 | 11/1984 | Rainer . | |
| 4,553,556 | 11/1985 | Lephardt . | |
| 4,574,821 | 3/1986 | Fischer . | |

OTHER PUBLICATIONS

Certain materials submitted to the Senate Committe on Commerce by Mr. Herbert A. Gilbert in Sep. of 1967.

A copy of Mr. Gilbert's U.S. Pat. No. 3,200,819 (1965).

Guinness Book of World Records, pp. 242–243 (1985 Edition).

Guinness Book of World Records, p. 194 (1966 Edition).

Hackh's Chemical Dictionary, 34, (4th Ed., 1969).

Lange's Handbook of Chemistry, 10, 272–274 (11th Ed., 1973).

Ames et al., Mut. Res., 31: 347–364 (1975).

Nago et al., Mut. Res. 42:335 (1977).

SMOKING ARTICLE WITH IMPROVED FUEL ELEMENT

BACKGROUND OF THE INVENTION

The present invention relates to a smoking article which preferably produces an aerosol that resembles tobacco smoke and which preferably contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel element in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch (63.5 mm) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstructed tobacco, surrounding a metal tube containing tobacco, reconstructed tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed. See also, British Patent No. 1,185,887 which discloses similar articles.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No, 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17–35. Similar tobacco fuel articles are described in U.S. Pat. No. 4,347,855 to Lanzillotti et al. and in U.S. Pat. No. 4,391,285 to Burnett et al. European Patent Appln. No. 117,355, to Hearn, describes similar smoking articles having a pyrolyzed lingo-cellulosic heat source having an axial passageway therein. These articles would suffer many of the same problems as the articles proposed by Bolt et al.

Steiner, in U.S. Pat. No. 4,474,191 describes "smoking devices" containing an air-intake channel which, except during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 & 10), the device is provided with a hard, heat transmitting envelope. Materials reported to be useful for this envelope include ceramics, graphite, metals, etc. In another embodiment, Steiner envisions the replacement of his tobacco (or other combustible material) fuel element with some purified cellulose-based product in an open cell configuration, mixed with activated charcoal. This material, when impregnated with an aromatic substance is stated to dispense a smoke-free, tobacco-like aroma.

Thus, despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention relates to a smoking article which is capable of producing substantial quantities of aerosol, both initially and over the useful life of the product, preferably without significant thermal degradation of the aerosol former and without the presence of substantial pyrolysis or incomplete combustion products or sidestream smoke. Preferred articles of the present invention are capable of providing the user with the sensations and benefits of cigarette smoking without the necessity of burning tobacco.

These and other advantages are obtained by providing an elongated, cigarette type smoking article which utilizes a short, i.e., less than 30 mm long, preferably carbonaceous, fuel element having two or more longitudinal passageways at least partially therethrough, in conjunction with a physically separate aerosol generating means having one or more aerosol forming materials which is in a conductive heat exchange relationship with the fuel element. Preferably, there are at least three such longitudinal passageways in the fuel element, more preferably 5 to 9 passageways, or more. The number, size, configuration, and spacing of the passageways are selected to help control the transfer of heat from the burning fuel element to the aerosol forming materials located in the aerosol generating means. This, in turn, helps to control the volatilization of those materials and their delivery to the user in the form of a "smoke-like" aerosol through the mouth end of the article. Preferred embodiments of the invention also help to improve ease of lighting, the overall and/or per puff aerosol delivery, flavor delivery, and/or the amount of carbon monoxide delivered by the article. In many preferred embodiments, the passageways are closely spaced so that they coalesce into a single passageway at the lighting end during burning.

The fuel elements useful in this invention are preferably less than about 20 mm in length, more preferably less than about 15 mm in length, from 2 to 8 mm in diameter, and have a density of at least about 0.5 g/cc.

The conductive heat exchange relationship between the fuel and the aerosol generator is preferably achieved by providing a heat conducting member, such as a metal conductor, which efficiently conducts or transfers heat from the burning fuel element to the aerosol generating means. This heat conducting member preferably contact the fuel element and the aerosol generating means around at least a portion of their peripheral surfaces, and it may form the container for the aerosol forming materials. Preferably, the heat conducting member is recessed from the lighting end of the article, advantageously by at least about 3 mm or more, preferably by at least 5 mm or more, to avoid interfering with the lighting and burning of the fuel element and to avoid any protrusion of the heat conducting member after the fuel element is consumed.

In addition, at least a part of the fuel element is preferably provided with a peripheral insulating member, such as a jacket of insulating fibers, the jacket being preferably resilient and at least 0.5 mm thick, which reduces radial heat loss and assists in retaining and directing heat from the fuel element toward the aerosol generating means and may aid in reducing the fire causing propensity of the fuel element. The insulating member preferably overwraps at least part of the fuel element, and advantageously at least part of the aerosol generating means, and thus helps simulate the feel of a conventional cigarette.

Smoking articles of the type described herein are particularly advantageous because the hot, burning fire cone is always close to the aerosol generating means, which maximizes heat transfer thereto and maximizes the resultant production of aerosol, especially in embodiments which are provided with a heat conducting and/or insulating member. In addition, because the aerosol forming substance is physically separate from the fuel element, it is exposed to substantially lower temperatures than are present in the burning fire cone, thereby minimizing the possibility of thermal degradation of the aerosol former.

The smoking article of the present invention is normally provided with a mouthend piece including means, such as a longitudinal passageway, for delivering the aerosol produced by the aerosol generating means to the user. Advantageously, the article has the same overall dimensions as a conventional cigarette, and as a result, the mouthend piece and the aerosol delivery means usually extend about one-half or more of the length of the article. Alternatively, the fuel element and the aerosol generating means may be produced without a built-in mouthend piece or aerosol delivery means, for use with a separate, disposable or reusable mouthend piece, e.g., a cigarette holder.

The smoking article of the present invention may also include a charge of tobacco which is used to add tobacco flavors to the aerosol. Advantageously, the tobacco may be placed at the mouthend of, or around the periphery of, the aerosol generating means, and/or it may be mixed with the carrier for the aerosol forming substance. Other substances such as flavoring agents, may be incorporated in a similar manner. In some embodiments, a tobacco charge may be used as the carrier for the aerosol forming substance. Tobacco or a tobacco extract flavor may alternatively, or additionally, be incorporated in the fuel element to provide additional tobacco flavor.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, aerosol former including any desired flavors or other desired volatile materials, and trace amounts of other materials. This aerosol has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal/(sec)($cm^2$)(°C/cm), of less than about 0.05. preferably less than about 0.02, most preferably less than about 0.005, See, *Hackh's Chemical Dictionary* 173 (4th ed., 1969) and Lange's *Handbook of Chemistry* 10, 272–274 (11th ed., 1973).

The preferred smoking articles of the present invention are described in greater detail in the accompanying drawings and in the detailed description of the invention which follow.

BRIEF DESCRIPTION OF THE DRAWINGS

FIGS. 1A, 2A, 2B, 3A, 4A, 4B, 5A, 5B, 6A, and 7A–7C, are sectional views of various fuel element passageway configurations useful in the embodiments of the present invention;

DETAILED DESCRIPTION OF THE PREFERRED EMBODIMENTS

Figure 1:
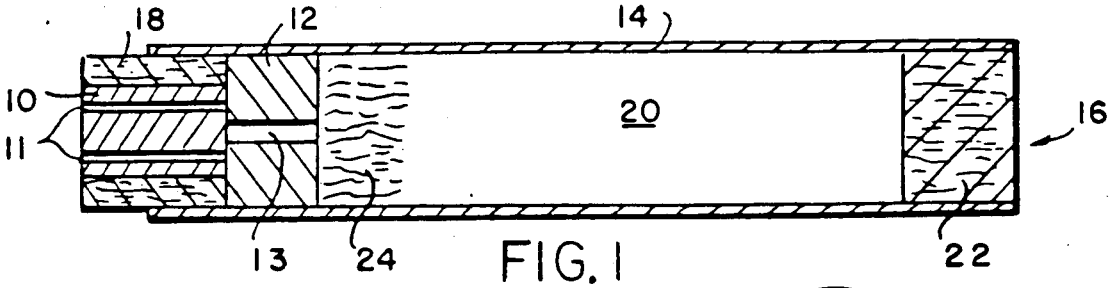
FIGS. 1 through 6 are sectional views of various embodiments of the present invention.
Figure 1A:
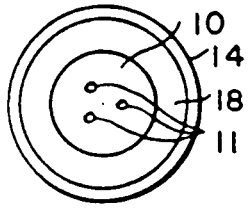

The embodiment of the invention illustrated in FIG. 1, which has about the same diameter as a conventional cigarette, includes a short, combustible carbonaceous fuel element 10, an abutting aerosol generating means 12, and a foil-lined paper tube 14 which provides mouthend piece 16. In this embodiment, the fuel element 10 is a pressure formed carbon rod, which is provided with three longitudinally extending passageways 11. FIG. 1A illustrates one suitable passageway configuration contemplated by the present invention. The fuel element 10 is surrounded by a resilient jacket of insulating fibers 18 to an outer diameter nearly that of a conventional cigarette. The aerosol generating means, comprising porous carbon mass 12, is provided with one or more passageways 13 and is impregnated with one or more aerosol forming substances, such as triethylene glycol, propylene glycol, glycerin, or mixtures thereof.

The foil-lined paper tube 14, which forms the mouthend piece, surrounds carbon mass 12 and the rear periphery of the insulating jacket 18. The tube also forms an aerosol delivery passageway 20 between the carbon mass 12 and the mouth end 16. For appearance sake, the article may also include an optional low efficiency cellulose acetate filter 22, positioned at or near mouth end 16.

The article illustrated in FIG. 1 also includes an optional mass of tobacco 24 which contributes flavors to the aerosol. This tobacco charge 24 may be placed at the mouth end of carbon mass 12, as shown in FIG. 1, or it may be placed in passageway 20, at a location spaced from the carbon mass.

Figure 2:
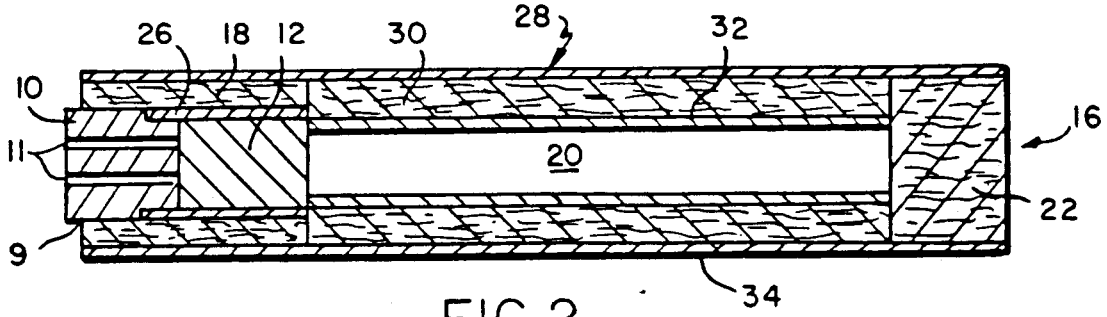

In the embodiment shown in FIG. 2, the fibrous insulating jacket 18 surrounds the periphery of both the pressure formed carbonaceous fuel element and the porous carbon mass aerosol generating means 12. In this embodiment, fuel element 10 has three equally sized passageways 11, such as those illustrated in FIGS. 2A and 2B, and the lighting end 9 of fuel element 10 extends slightly beyond the fiber jacket 18 for ease of lighting. Carbon mass 12 and the rear portion of the fuel element 10 are surrounded by a piece of aluminum foil 26 to conduct heat from the fuel element to carbon mass 12. The heat conductor 26 also helps to extinguish the fire cone when the fuel element burns back to the point of contact with conductor 26 by acting as a heat sink.

This embodiment is provided with a mouthend piece comprising a cellulose acetate tube 28, in place of the foil-lined tube of FIG. 1. This tube includes an annular section 30 of cellulose acetate tow surrounding an optional plastic, e.g., polypropylene or Mylar tube 32. At mouth end 16 of this embodiment there is a low efficiency cellulose acetate filter plug 22. The combination of cellulose acetate tube 28, filter plug 22, and the jacketed fuel element/carbon mass are coupled by an overwrap of cigarette paper 34.

Figure 3:
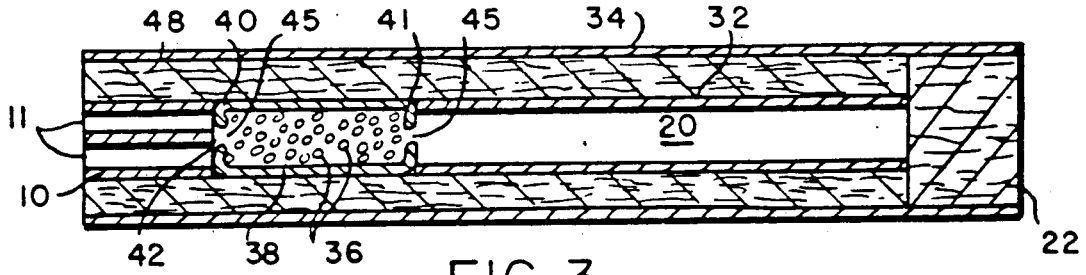
Figure 3A:
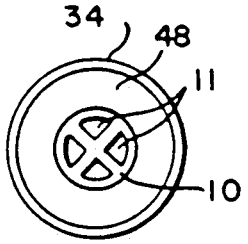

In the embodiment shown in FIG. 3, an extruded carbonaceous fuel element is employed, with four distinct passageways 11, each having a "wedge shape" or segment configuration as shown in FIG. 3A. The aerosol generating means comprises a granular substrate 36 which includes one or more aerosol forming substances, in lieu of the carbon mass 12 of the previous embodiments, and this substrate is contained within a metallic container 38 formed from a metal tube crimped at ends 40 and 41, to enclose substrate 36 and to inhibit migration of the aerosol former. Crimped end 40, at the fuel end, preferably abuts the rear end of the fuel element to provide conductive heat transfer. A void space 42 formed by end 40 also helps to inhibit migration of the aerosol former to the fuel element. Passageways 45 are provided to permit passage of air and the aerosol forming substance. The metallic container 38 may also enclose a mass of tobacco which may be mixed with the granular substrate 36 or used in lieu thereof.

In this embodiment the fibrous insulating jacket 48 extends from the lighting end of fuel element 10 to the cellulose acetate filter plug 22. A plastic tube 32, e.g., polypropylene, Mylar, Nomex, or like material, is located inside the fiber jacket 48, between the metallic container 38 and the filter plug 22, providing a passageway 20 for the aerosol forming substance. This embodiment is overwrapped with cigarette paper 34.

Figure 4:
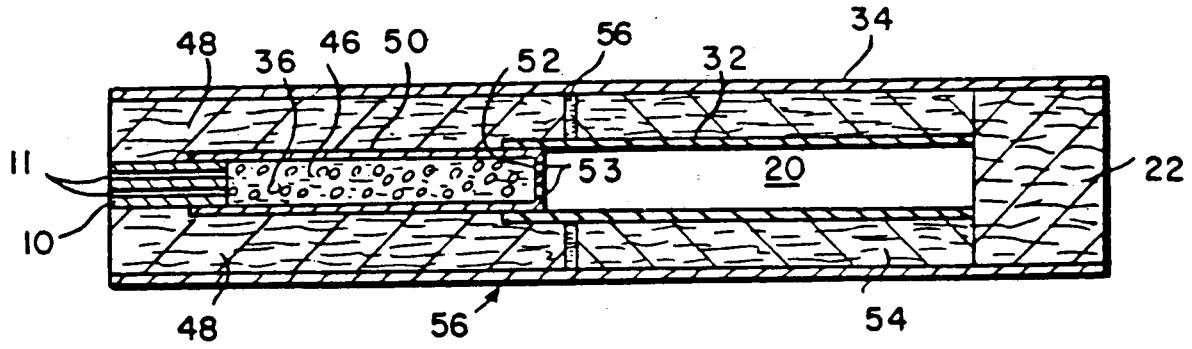
Figure 4A:
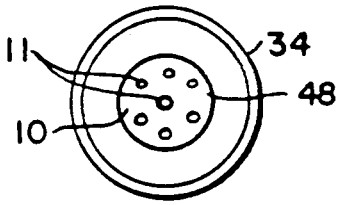
Figure 4B:
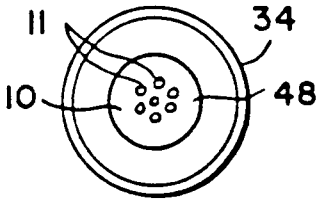

In the embodiment shown in FIG. 4, an extruded carbonaceous fuel element 10 is provided with seven passageways. FIGS. 4A and 4B illustrate two different passageway configurations useful in the articles of the present invention. In this embodiment, the aerosol generating means comprises metallic container 50 which encloses granular substrate 36, including an aerosol forming substance, and/or tobacco. As illustrated, one end of metallic container 50 overlaps about 2 to 3 mm of (or abuts) the rear periphery of fuel element 10. The opposite end of container 50 is crimped to form wall 52, having a plurality of passageways 53, thus permitting passage of air, the aerosol forming substance, and/or tobacco flavors. Plastic tube 32 overlaps (or abuts) walled end 52 of metallic container 50. One or more layers of insulating fibers 48 are wrapped around fuel element 10 and metallic container 50, to form a resilient jacket about the diameter of a conventional cigarette. Plastic tube 32 is surrounded by a section of high density cellulose acetate tow 54. A layer of glue 56 may be applied to the fuel end of tow 54 to seal the tow and block air flow therethrough. A filter plug 22 is located contiguous to the mouth end of tow 54. The entire length of the article, or sections thereof, may be overwrapped with one or more layers of cigarette paper 34.

Figure 5:
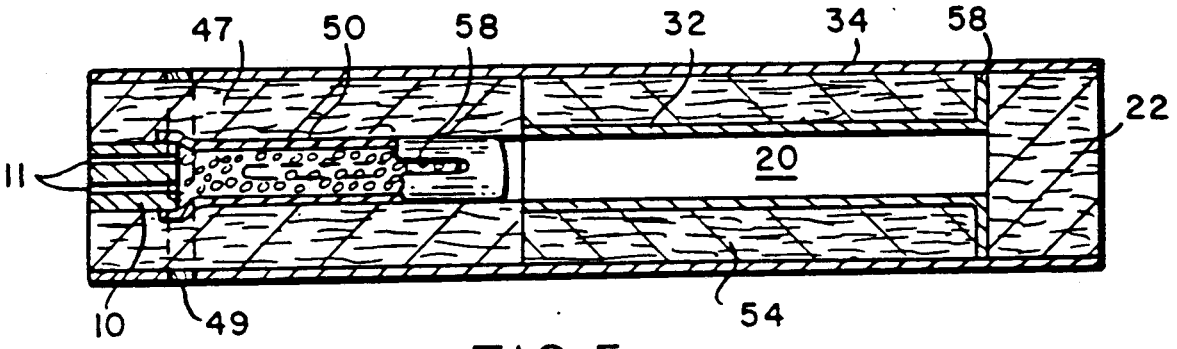

The embodiment illustrated in FIG. 5 is similar to that of FIG. 4, except that the extruded carbonaceous fuel element has nine distinct passageways (see FIG. 5A), and jacket 47 comprises tobacco or an admixture of tobacco and insulating fibers such as glass fibers. As illustrated, the tobacco jacket extends just beyond the mouth end of the aerosol generating means. In embodiments of this type the container is preferably provided with longitudinal slots 58 on its periphery, in lieu of passages 53, so that the vapors from the aerosol generator pass through the annular section of tobacco which surrounds the aerosol generating means before entering the aerosol delivery passage 20.

In embodiments of this type, it is highly preferable to treat a portion 49 of the cigarette paper overwrap near the rear end of the fuel with a material such as sodium silicate to help prevent burning of the tobacco behind the exposed portion of the fuel element. Alternatively, the tobacco jacket itself may be treated with a burn modifier to prevent burning of the tobacco which surrounds the aerosol generator.

Figure 5A:
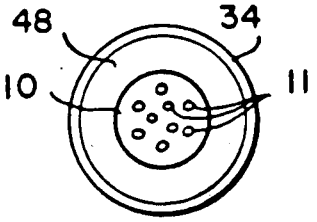
Figure 5B:
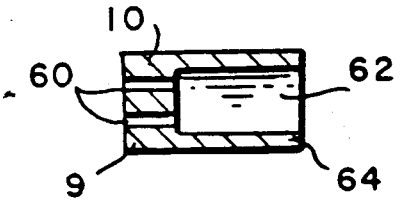

FIG. 5B illustrates another passageway configuration suitable for use in the smoking articles of the present invention. In this embodiment, three or more, preferably seven to nine, passageways 60 begin at lighting end 9 of fuel element 10 and pass only partially there through. At a point within the body of fuel element 10, the passageways 60 merge with a large cavity 62 which extends to the mouth end 64 of fuel element 10. Such a passageway/cavity combination as illustrated in FIG. 5B has been found to be particularly advantageous for low CO delivery and in ease of lighting. The cavity may be from about 30% to 95%, preferably greater than about 70%, of the length of the fuel element, with a cross sectional diameter sufficiently large to connect with all of the passageways 60. For example, in a 10 mm long, 4 mm diameter fuel element having closely packed passageways, the cavity length would be from about 6 to 9 mm, preferably about 8 mm, and the cavity diameter would be between about 1.5 to 2 mm.

Figure 6:
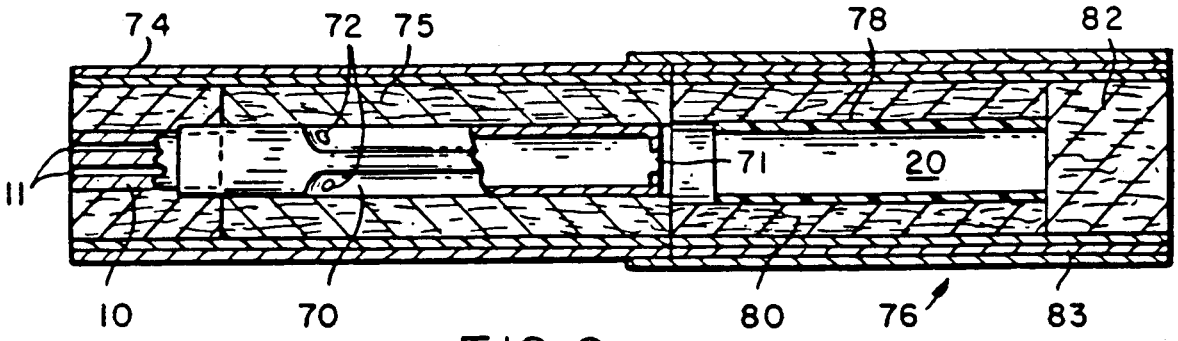
Figure 6A:
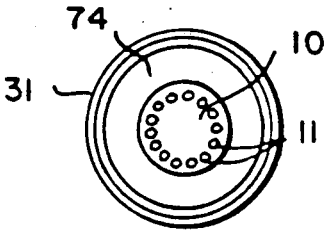

FIG. 6 illustrates another jacketed embodiment of the smoking article of the present invention. As illustrated in FIG. 6A, fuel element 10 is provided with a plurality of passageways 11, situated near the outer edge of the fuel element. Overlapping the mouth end of fuel element 10 is a metallic capsule 70 which contains a substrate material. Preferred substrates which may be utilized in capsule 70 include granular carbon, granular alumina, tobacco or mixtures thereof.

Figure 6B:
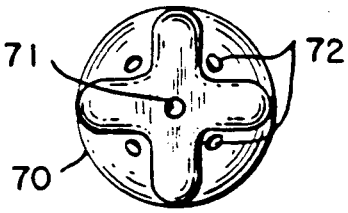
FIG. 6B is an end view of the metallic capsule used in the article of FIG. 6.

The rear portion of the capsule is crimped as shown in FIG. 6B. A passage 71 is provided at the mouth end of the capsule in the center of the crimped tube, as illustrated. Four additional passages 72 are provided at the transition points between the crimps and the uncrimped portion of the capsule.

In this embodiment, the periphery of the fuel element is surrounded by a resilient jacket 74 of glass insulating fibers, and capsule 70 is surrounded by a jacket of tobacco 75. At the mouth end of the tobacco jacket is a mouthend piece 76 comprised of a cellulose acetate cylinder 78, a centrally located plastic tube 80, and a low efficiency cellulose acetate filter piece 82. The entire article, or portions thereof, may be overwrapped with one or more layers of cigarette paper 83. As illustrated, the capsule end of plastic tube 80 does not abut the capsule. Thus, vapors flowing through passages 72 and tobacco jacket 75 flow into passageay 20 where the tobacco jacket abuts the cellulose acetate cylinder 78.

Upon lighting any of the aforesaid embodiments, the fuel element burns, generating the heat used to volatilize the aerosol forming substance or substances in the aerosol generating means. Because the preferred fuel element is relatively short, the hot, burning fire cone is always close to the aerosol generating means. This proximity to the burning fire cone, together with the plurality of longitudinal passageways in the fuel element, which increases the rate of burning, helps to control transfer of heat from the burning fuel element to the aerosol generating means. Control of heat transfer to the aerosol generating means is important both in terms of transferring enough heat to produce sufficient aerosol and in terms of avoiding the transfer of so much heat that the aerosol former is degraded.

It has been discovered that the size, configuration, and number of passageways in the fuel element can be varied to help deliver the appropriate amount of heat to the aerosol generating means. A large number of passageways, especially with a relatively wide spacing between the passageways, produces high convective heat transfer, which leads to high aerosol delivery. A large number of passageways generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby lowering the aerosol delivery rate and amount. However, it has been discovered that with passageway arrangements which are closely spaced such that they burn out or coalesce to form one passageway, the amount of CO in the combustion products is lower than in the same arrangement but widely spaced.

The optimum arrangement, configuration and number of fuel element passageways should deliver a steady and high supply of aerosol, allow for easy ignition, and produce low CO. Various combinations have been examined for passageway arrangement/configuration and/or number in carbonaceous fuel elements. It has been discovered that fuel elements having from about 5 to 9 passageways, relatively closely spaced such that they burn away into one large cavity, at least at the lighting end of the fuel element, appear to most closely satisfy the requirements of a preferred fuel element, especially for dense carbonaceous fuel elements. Preferably, the core diameter, i.e., the diameter of the smallest circle which will circumscribe the outer edges of the passageways in the fuel element, should range from about 1.6 mm to about 2.5 mm for fuel elements having seven passageways of about 0.5 mm diameter. When the diameter of the fuel element passageway is increased to about 0.6 mm, the core diameter preferably increases to a range of from about 2.1 mm to about 3.0 mm. Variables which affect the rate at which the fuel element passageways will coalesce upon burning include, the density of the fuel element, the distance between the passageways, the number of passageways, the configuration thereof, and arrangement thereof.

Another preferred embodiment is the configuration illustrated in FIG. 5B. In that embodiment, the short section of the fuel element comprising the plurality of passageways, i.e., 3, 4, 5, 6, or more, provides the large surface area required for ease of lighting and early aerosol delivery. The cavity, which normally occupies more than half the length of the fuel element, helps assure uniform heat transfer to the aerosol generating means, and delivers low CO to the mainstream.

The control of heat transfer may be aided by the use of a heat conducting member, such as a metallic foil or a metallic enclosure for the aerosol generating means, which contacts or couples the fuel element and the aerosol generating means. Preferably, this member is recessed, i.e., spaced from, the lighting end of the fuel element, by at least about 3 mm, preferably by at least about 5 mm or more, to avoid interference with the lighting and burning of the fuel element and to avoid any protrusion after the fuel element is consumed.

The control of heat transfer may also be aided by the use of an insulating member as a peripheral overwrap over at least a part of the fuel element, and advantageously over at least a part of the aerosol generating means. Such an insulating member ensures good aerosol production by retaining and directing much of the heat generated by the burning fuel element toward the aerosol generating means.

Because the aerosol forming substance in preferred embodiments is physically separate from the fuel element, and because the number, arrangement, or configuration of passageways (or a combination thereof) in the fuel element allow for the controlled transfer of heat from the burning fuel element to the aerosol generating means, the aerosol forming substance is exposed to substantially lower temperatures than are generated by the burning fuel, thereby minimizing the possibility of its thermal degradation. This also results in aerosol production almost exclusively during puffing, with little or no aerosol production during smolder. In addition, the use of a carbonaceous fuel element eliminates the presence of substantial pyrolysis or incomplete combustion products and the presence of substantial sidestream aerosol.

Because of the small size and burning characteristics of the preferred fuel elements employed in the present invention, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Heat transfer, and therefore aerosol delivery, is especially enhanced by the presence of a plurality of passageways in the fuel element which allow the rapid passage of hot gases to the aerosol generator, especially during puffing. Because the preferred fuel element is so short, there is never a long section of nonburning fuel to act as a heat sink, as was common in previous thermal aerosol articles.

In the preferred embodiments of the invention, the short carbonaceous fuel element, heat conducting member, insulating means, and passages in the fuel cooperate with the aerosol generator to provide a system which is capable of producing substantial quantities of aerosol, on virtually every puff. The close proximity of the fire cone to the aerosol generator after a few puffs, together with the insulating means, results in high heat delivery both during puffing and during the relatively long period of smolder between puffs.

In general, the combustible fuel elements which may be employed in practicing the invention have a diameter no larger than that of a conventional cigarette (i.e., less than or equal to 8 mm), and are generally less than about 30 mm long. Advantageously the fuel element is about 20 mm or less in length, preferably about 15 mm or less in length. Advantageously, the diameter of the fuel element is between about 3 to 7 mm, preferably about 4 to 5 mm. The density of the fuel elements employed herein has ranged from about 0.5 g/cc to about 1.5 g/cc. Preferably the density is greater than 0.7 g/cc, more preferably greater than 0.8 g/cc.

The preferred fuel elements employed herein are primarily formed of a carbonaceous material. Carbonaceous fuel elements are preferably from about 5 to 15 mm, more preferably, from about 8 to 12 mm in length. Preferably, the density is greater than about 0.7 g/cc. Carbonaceous fuel elements having these characteristics are sufficient to provide fuel for at least about 7 to 10 puffs, the normal number of puffs generally obtained by smoking a conventional cigarette under FTC conditions.

Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight, are within the scope of this invention, especially where a minor amount of tobacco, tobacco extract, or a nonburning inert filler is used.

Also, while not preferred, other fuel materials may be employed, such as molded or extruded tobacco, reconstituted tobacco, tobacco substitutes and the like, provided that they generate and provide sufficient heat to the aerosol generating means to produce the desired level of aerosol from the aerosol forming material, as discussed above. The density of the fuel used should be above about 0.5 g/cc., preferably above about 0.7 g/cc., which is higher than the densities normally used in conventional smoking articles. Where such other materials are used, it is much preferred to include carbon in the fuel, preferably in amounts of at least about 20 to 40% by weight, more preferably at least about 50% by weight, and most preferably at least about 65 to 70% by weight, the balance being the other fuel components, including any binder, burn modifiers, moisture, etc.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. Preferably, the pyrolyzed material is then cooled, ground to a fine powder, and heated in an inert gas stream at a temperature between about 650° C. to 750° C. to remove volatiles prior to further processing.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein. Similarly, small amounts of aerosol forming substances may migrate from the aerosol generating means and thus may also be present in the fuel.

In other preferred embodiments, the fuel element may contain tobacco, tobacco extracts, and/or other materials, primarily to add flavor to the aerosol. Amounts of these additives may range up to about 25 weight percent or more, depending upon the additive, the fuel element, and the desired burning characteristics. Tobacco and/or tobacco extracts may be added to carbonaceous fuel elements e.g., at about 10 to 20 weight percent, thereby providing tobacco flavors to the mainstream and tobacco aroma to the sidestream akin to a conventional cigarette, without affecting the Ames test activity of the product.

A preferred carbonaceous fuel element is a pressed or extruded mass of carbon prepared from a powdered carbon and a binder, by conventional pressure forming or extrusion techniques. A preferred activated carbon for such a fuel element is PCB-G, and a preferred nonactivated carbon is PXC, both available from Calgon Carbon Corporation, Pittsburgh, Pa. Other preferred nonactivated carbons for pressure forming are prepared from pyrolized cotton or pyrolized papers, such as Grande Prairie Canadian Kraft, available from the Buckeye Cellulose Corporation of Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency. The dough is then extruded using a standard ram or piston type extruder into the desired shape, with the desired passageways, and dried, preferably at about 95° C. to reduce the moisture content to about 2 to 7 percent by weight. Alternatively, or additionally, the passageways and/or cavity may be formed using conventional drilling techniques. If desired, the lighting end of the fuel elements may be tapered or reduced in diameter by machining, molding, or the like, to improve lightability.

If desired, carbon/binder fuel elements (without tobacco, and the like) may be pyrolyzed after formation, for example, to about 650° C. for two hours, to convert the binder to carbon and thereby form a virtually 100% carbon fuel element.

The fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites and the like also may be used.

The aerosol generating means used in practicing this invention is physically separate from the fuel element. By physically separate it is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., Danbury, Conn., as well as SGL carbon, available from Calgon. Other suitable materials include inorganic solids, such as ceramics, glass, alumina, vermiculite, clays such as bentonite, and the like. Carbon and alumina substrates are preferred.

An especially useful alumina substrate is available from the Davison Chemical Division of W. R. Grace & Co. under the designation SMR-14-1896. This alumina is treated to make it suitable for use in the articles of the present invention by sintering at elevated temperatures, e.g., greater than 1000° C., washing, and drying.

It has been found that suitable particulate substrates also may be formed from carbon, tobacco, or mixtures of carbon and tobacco, into densified particles in a one-step process using a machine made by Fuji Paudal KK (formerly Fuji Denki Kogyo KK) of Japan, and sold under the trade name of "Marumerizer." This apparatus is described in German Patent No. 1,294,351 and U.S. Pat. No. 3,277,520 (now reissued as U.S. Pat. No. Re. 27,214) as well as Japanese published specification No. 8684/1967.

The aerosol forming substance or substances used in the articles of the present invention must be capable of forming an aerosol at the temperatures present in the aerosol generating means upon heating by the burning fuel element. Such substances preferably will be composed of carbon, hydrogen and oxygen, but they may include other materials. Such substances can be in solid, semisolid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or poly-carboxylic acids, such as methyl stearate, dimethyl dodecandioate, dimethyl tetradecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouth end, such as in a separate substrate or chamber or coated within the passageway leading to the mouth end, or in the optional tobacco charge.

One particularly preferred aerosol generating means comprises the aforesaid alumina substrate containing spray dried tobacco extract, tobacco flavor modifiers, such as levulinic acid, one or more flavoring agents, and an aerosol forming agent, such as glycerin. In certain preferred embodiments, this substrate may be mixed with densified tobacco particles, such as those produced on a "Marumerizer".

As shown in the illustrated embodiments, a charge of tobacco may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting member preferably employed in practicing this invention is typically a metallic tube or foil, such as aluminum foil, varying in thickness from less than about 0.01 mm to about 0.1 mm, or more. The thickness and/or the type of conducting material may be varied (e.g., Grafoil, from Union Carbide) to achieve virtually any desired degree of heat transfer. As shown in the illustrated embodiments, the heat conducting member preferably contacts or overlaps the rear portion of the fuel element, and may form the container which encloses the aerosol forming substance. Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in practicing the invention are preferably formed into a resilient jacket from one or more layers of an insulating material. Advantageously, this jacket is at least about 0.5 mm thick, preferably at least about 1 mm thick, and preferably from about 1.5 to 2.0 mm thick. Preferably, the jacket extends over more than about half of the length of the fuel element. More preferably, it also extends over substantially the entire outer periphery of the fuel element and the capsule for the areosol generating means. As shown in the embodiment of FIG. 6, different materials may be used to insulate these two components of the article.

Insulating members which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like may also be used. Preferred insulating members are resilient, to help simulate the feel of a conventional cigarette. Preferred insulating materials generally do not burn during use. However, slow burning materials and especially materials which fuse during heating, such as low temperature grades of glass fibers, may be used. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

The currently preferred insulating fibers are ceramic fibers, such as glass fibers. Two suitable glass fibers are available from the Manning Paper Company of Troy, N.Y., under the designations, Manniglas 1000 and Manniglas 1200. When possible, glass fiber materials having a low softening point, e.g., below about 650° C., are preferred. One such preferred glass fiber is an experimental material produced by Owens - Corning of Toledo, Ohio under the designation 6432.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 wt. percent, may be added to the fibers to provide mechanical strength to the jacket without contributing harsh aromas.

Alternatively, the insulating material may be replaced, in whole or in part, by tobacco, either loosely packed or tightly packed. The use of tobacco as a substitute for a part or all of the insulating jacket serves an additional function by adding tobacco flavors to the mainstream aerosol and producing a tobacco sidestream aroma. In preferred embodiments where the tobacco jacket encompasses the aerosol generating means, the jacket acts as a non-burning insulator, as well as contributing tobacco flavors to the mainstream aerosol. In embodiments where the tobacco encircles the fuel, the tobacco is preferably consumed only to the extent that the fuel element is consumed, i.e., up to about the point of contact between the fuel element and the aerosol generating means. This may be achieved by treating the cigarette paper overwrap and/or the tobacco with materials which help extinguish the tobacco at the point were it overlaps the aerosol generating means.

When the insulating means comprise fibrous materials other than tobacco, there may be employed a barrier means at the mouth end of the insulating jacket; or elsewhere near the mouth end of the article. One such barrier means comprises an annular member of high density cellulose acetate tow which abuts the fibrous insulating means and which is sealed, at either end, with, for example, glue, to block air flow through the tow.

In most embodiments of the invention, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the heat fire cone away from the mouth and fingers of the user, and provides sufficient time for the hot aerosol to form and cool before reaching the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include the cellulose acetate-polypropylene tube of FIGS. 2-6. Other suitable mouthpieces will be apparent to those of ordinary skill in the art.

The mouthend pieces of the invention may include an optional "filter" tip, which is used to give the article the appearance of the conventional filtered cigarette. Such filters include low efficiency cellulose acetate filter and hollow or baffled plastic filters, such as those made of polypropylene.

The entire length of the article or any portion thereof may be overwrapped with cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel element is not restricted. However, papers can be designed or engineered to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., 4-6).

To maximize aerosol delivery, which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include ECUSTA 01788 manufactured by Ecusta of Pisgah Forest, N.C., and Kimberly-Clark's KC-63-5 and P 878-5 papers.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., Mut. Res., 31:347-364 (1975); Nagas et al., Mut. Res., 42:335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

Smoking articles of the type illustrated in FIG. 4 were made with an extruded carbon fuel element in the following manner.

A. Fuel Element Preparation

Grand Prairie Canadian (GPC) Kraft paper made from hardwood and obtained from Buckeye Cellulose Corp., Memphis, Tenn., was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350° C. for 2 hours. The temperature of the furnace was then increased at 5° C. per hour to 650° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon (CGPC) had a tapped density of 0.6 grams/cubic centimeter and hydrogen plus oxygen level of 4%.

Nine parts of this carbon powder was mixed with one part of SCMC powder, $K_2CO_3$ was added at 1 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudant had tapered surfaces to facilitate smooth flow of the plastic mass. A low pressure (less than 5 tons per square inch or 7.03×106 kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had an apparent (bulk) density of about 0.9 g/cc, a diameter of 4.5 mm, and an out of roundness of approximately 3%.

Figure 2A:
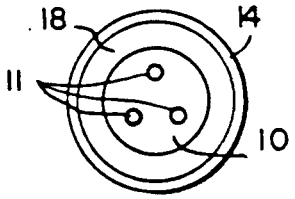
Figure 2B:
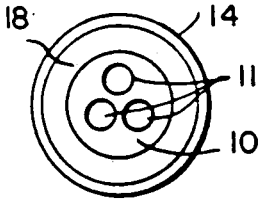

The dry, extruded rod was cut into 10 mm lengths and three 0.5 mm holes were drilled through the length of the rod as illustrated in FIG. 2A.

B. Assembly

The metallic containers for the substrate were 30 mm long spirally wound aluminum tubes obtained from Niemand, Inc., having a diameter of about 4.5 mm. One end of each of these tubes was crimped to form an end with a small hole. Approximately 180 mg of PG-60, a granulated graphite, was used to fill each of the containers. This substrate material was loaded with approximately 75 mg of a 1:1 mixture of glycerin and propylene glycol. After the metallic containers were filled, each was joined to a fuel rod by inserting about 2 mm of the fuel rod into the open end of the container. Each of these units was then joined to a 35 mm long polypropylene tube of 4.5 mm internal diameter by inserting one end of the tube over the walled end of the container.

Each of these core units was placed on a sheet of Manniglas 1200 pretreated at about 600° C. for up to about 15 min. in air to eliminate binders, and rolled until the article was approximately the circumference of a cigarette. An additional double wrap of Manniglas 1000 was applied around the Manniglas 1200. The ceramic fiber jacket was cut away from 10 mm of the mouth end of the polypropylene tube so that a 10 mm long annular segment of cellulose acetate filter material could be placed over the polypropylene tube. The mouth end of this segment was heavily coated with a conventional adhesive to block air flow through the filter material. A conventional cellulose acetate filter plug of 10 mm length was butted against the adhesive. The entire unit was then wrapped with ECUSTA 01788 perforated cigarette paper, and a conventional tipping paper was applied to the mouth end.

EXAMPLE 2

Smoking articles prepared in a manner similar to Example 1, having three holes in the fuel rod, as shown in FIG. 2A, demonstrated increased aerosol on the immediate second puff (i.e., a puff taken two seconds after the lighting puff) when compared to a similar article with a single hole fuel element. Similar smoking articles made with more than three holes, such as the 9 hole rod shown in FIG. 5A and a segment or "wedge" shaped hole configuration as shown in FIG. 3A produced even more aerosol on the immediate second puff, with the 9 hole embodiment producing remarkably increased immediate second puff aerosol when compared to single hole fuel elements.

Similar smoking articles have been prepared with tobacco, either mixed with or used in lieu of the substrate, with similar results.

EXAMPLE 3

Figure 7:
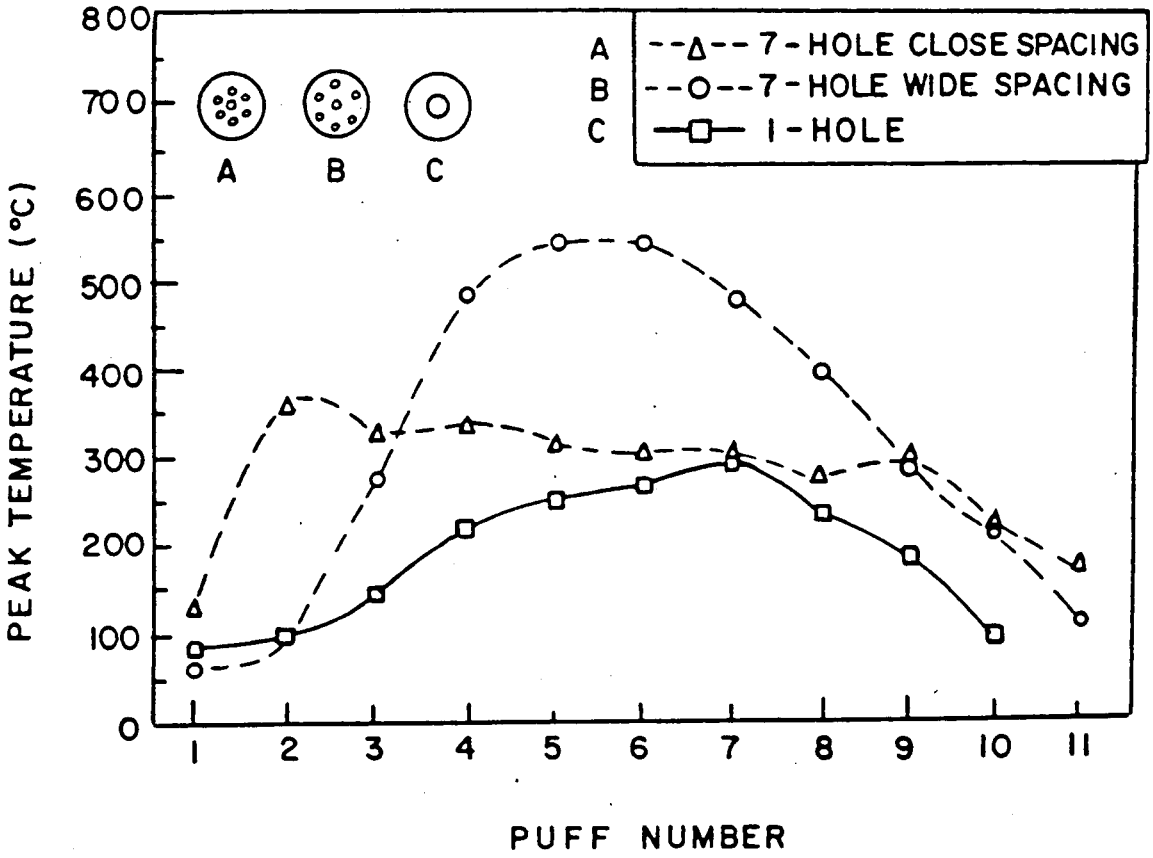
FIG. 7 illustrates the fuel element temperature profiles for fuel elements 7A, 7B, and 7C.

Fuel elements (10 mm long, 4.5 mm diameter) were prepared in a manner similar to Example 1, except that the number and arrangement of passageways was modified as described herein. FIG. 7 represents the results of puff temperature measurements for the fuel elements of this example using a 35 ml puff volume and a two second puff duration. The temperature measurement for puff 1 was taken one second after ignition and the second puff was taken four seconds after ignition with the temperature measurement for puff 2 being taken five seconds after ignition. All subsequent temperature measurements were taken one second after puff initiation. The third puff was taken 54 seconds after completion of the second puff. Subsequent puffs were taken at 60 second intervals. The temperatures were measured 15 mm behind the fuel elements inserted about 2 to 3 mm inside an empty metal tube.

The fuel element of example 3A had 7 holes (ea. d=0.5 mm), arranged in a closely spaced pattern as shown at A in FIG. 7. The core diameter of fuel element A was about 1.9 mm and the spacing between these holes was about 0.2 mm. This fuel element delivered the most heat on the first and second puffs as shown in FIG. 7. During burning, the fuel between the holes burned away and a single large hole was formed at the lighting end of the fuel element, i.e., the passageways coalesced.

The fuel element of example 3B had 7 holes (ea. d=0.5 mm) in a widely spaced pattern shown at B in FIG. 7. The core diameter of fuel element B was about 3.0 mm and the spacing between the holes was about 0.75 mm. The passageways in this fuel element did not coalesce during the burning of the fuel element. The temperature profile of this fuel element is illustrated in FIG. 7.

The fuel element of example 3C had a single (d=1.5 mm) axial hole as shown at C in FIG. 7. When ignited with an infrared heater, the fuel element ignited along its outer edge and the combustion area spread slowly across the face of the element.

EXAMPLE 4

Fuel elements were prepared in a manner similar to Example 3 having an apparent (bulk) density of about 0.92 g/cc. Between the ceramic jacket and the overwrap paper was a layer of nonporous, nonburning, experimental mica paper obtained from Corning Glass Works, Corning, N.Y. and believed to be prepared in accordance with the teachings of U.S. Pat. No. 4,297,139. This paper was provided with twenty-one 3/32 inch diameter holes in the 10 mm long area around the fuel element to afford about 48% open area around the fuel element.

When smoked under FTC conditions, using a hollow metal tube as in Example 3, the average mainstream CO delivery for fuel elements having a closely spaced seven hole arrangement with a core diameter of about 2.2 mm (similar to fuel element A in FIG. 7) was 22 mg over a total of 12 puffs; the average CO delivery for fuel elements having the widely spaced hole arrangement (similar to fuel element B in FIG. 7), with a core diameter of about 3.0, was 33 mg over 11 puffs; and the average mainstream CO delivery for single hole fuel elements (similar to fuel element C in FIG. 7, d=2.5 mm) was 5 mg over nine puffs.

EXAMPLE 5

A fuel element was prepared in a manner similar to Example 3 with the widely spaced 7 hole arrangement similar to B in FIG. 7. The seven holes extended back only 1 mm from the lighting end of the fuel element where they opened into a large cavity (2.5 mm in diameter) which extended to the mouth end of the fuel element. When smoked under FTC conditions as in Example 3, the CO delivery for this fuel element was 9 mg over a total of 9 puffs, for an average delivery of 1 mg CO per puff.

EXAMPLE 6

Fuel elements were prepared in a manner similar to Example 1, with fuel element passageways as described herein. In addition to carbonized paper and SCMC binder, fuel element 6A (10 mm×4.5 mm) included 20 wt. percent Burley tobacco within the extruded mixture. The fuel element had four wedge shaped passageways similar to that shown in FIG. 3A.

Example 6B utilized a fuel element (10 mm×4.47 mm) with nine passageways (six outer periphery, 3 tight packed in center) i.e., similar to that shown in FIG. 5A. The three central passageways extended into the fuel element 2 mm and met a central cavity similar to that shown in FIG. 5B (8 mm×1.5 mm), which contained 25 mg of "Marumerized" (i.e., densified) flue cured tobacco (about 1 mm×0.3 mm).

Metallic capsules were as prepared in Example 1, part B. Glycerin (8.0 grams) was admixed with 4.0 grams of finely ground (1.0 to 30 micron) spray dried tobacco extract (infra). PG-60 granulated carbon (12.0 grams) was added to the slurry which was then stirred until the substrate was dry to the touch. Such a treated substrate was used to load the metallic capsule.

The tobacco extract used in this example was prepared as follows. Tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

Three articles of example 6A and four articles of example 6B were smoked without mouthend pieces and the WTPM for each group was collected on a single pad. The articles were smoked on a conventional cigarette smoking machine using the conditions of a 50 ml puff volume, a two second puff duration, and a 30 second puff frequency, for ten puffs (Ex. 6A) or thirteen puffs (Ex. 6B). This afforded the following wet total particulate matter (WTPM) for the indicated groups of articles:

| | TOTAL WTPM | AVERAGE WTPM PER ARTICLE |
|---|---|---|
| Example 6A | 141.3 mg | 47.1 mg |

-continued

| | TOTAL WTPM | AVERAGE WTPM PER ARTICLE |
|---|---|---|
| Example 6B | 199.4 mg | 49.8 mg |

EXAMPLE 7

A preferred smoking article of the present invention was prepared in the following manner.

The fuel element (10 mm long, 4.5 mm o.d.) having an apparent (bulk) density of about 0.86 g/cc, was prepared with 10 wt. percent spray dried flue cured tobacco extract (made in accordance with Example 6) in addition to carbon, SCMC binder (10 wt. percent) and $K_2C0_3$ (1 wt. percent). The carbon was prepared in a manner similar to Example 1, but at a carbonizing temperature of 750° C. After cooling, the carbon was ground to a mesh size of minus 200. The powdered carbon was then heated to a temperature of 650° C. to 750° C. to remove volatiles. The fuel element was extruded with seven holes (each about 0.6 mm diameter) in a closely spaced arrangement (similar to fuel element A in FIG. 7) with a core diameter of about 2.6 mm and spacing between the holes of about 0.3 mm.

The macrocapsule was prepared from the aluminum tubing of Example 1, i.e., about 4.5 mm outer diameter drawn aluminum, about 30 mm in length. The rear 2 mm of the capsule was crimped to seal the mouth end of the capsule. At the mouth end, four equally spaced grooves were indented in the side of the capsule, each to a depth of about 0.75 mm to afford a "lobe-shaped" capsule similar to that illustrated in FIG. 6B. This was accomplished by inserting the capsule into a die having four equally spaced wheels of about 0.75 mm depth located such that the rear 18 mm of the capsule was grooved to afford four equally spaced channels. Four holes (each about 0.72 mm diameter) were made in the capsule at the transition between the ungrooved portion of the capsule and each of the grooves (as shown in FIG. 6B). In addition, a central hole (d=about 0.72 mm) was made in the sealed end of the capsule, approximately 17 mm from the holes at the fuel end of the grooves.

High surface area alumina (surface area=280 $m^2/g$) from W. R. Grace & Co. (designated SMR-14-1896), having a mesh size of from −8 to +14 (U.S.) was sintered at a soak temperature above about 1400° C., preferably from about 1400° to 1550° C., for about one hour and cooled. The alumina was washed with water and dried. The alumina (640 mg) was treated with an aqueous solution containing 107 mg of spray dried flue cured tobacco extract (prepared as in Example 6) and dried to a moisture content of from about 1 to 5, preferably about 3.5, weight percent. This material was then treated with a mixture of 233 mg of glycerin and 17 mg of a flavor component obtained from Firmenich, Geneva, Switzerland, under the designation T69-22. The capsule was filled with a 1:1 mixture of the treated alumina and densified (i.e., Marumerized) flue cured tobacco having a density of about 0.8 g/cc and loaded with 15 wt. percent glycerin.

The fuel element was inserted into the open end of the filled macrocapsule to a depth of about 3 mm. The fuel element-macrocapsule combination was overwrapped at the fuel element end with a 10 mm long, glass fiber jacket of Owens-Corning 6432 (having a softening point of about 640° C.), with 3 wt. percent pectin binder, to a diameter of about 8 mm.

An 8 mm diameter tobacco rod (28 mm long) with a conventional cigarette paper overwrap was modified to have a longitudinal passageway (about 4.5 mm diameter) therein. The jacketed fuel element-macrocapsule combination was inserted into the tobacco rod passageway until the glass fiber jacket abutted the tobacco. The glass fiber and tobacco sections were overwrapped with Kimberly Clark 780-63-5 and P 878-5 papers.

A cellulose acetate mouthend piece (30 mm long), containing a 28 mm long polypropylene tube, recessed 2 mm from the fuel element end, of the type illustrated in FIG. 6, was joined to a filter element (10 mm long) with a nonporous plug wrap. This mouthend piece section was joined to the jacketed fuel element-macrocapsule section by a paper overwrap and tipping paper was applied over the mouth end.

What is claimed is:

1. A cigarette-type smoking article comprising:

(a) a carbonaceous fuel element having a plurality of longitudinal passageways at least partially therethrough, said passageways having a predetermined shape;

(b) a physically separate aerosol generating means including an aerosol forming material; and (c) means for delivering the aerosol produced by the aerosol generating means to the user of the article.

2. The smoking article of claim 1, wherein the fuel element has at least three passageways.

3. The smoking article of claim 2, wherein the passageways are arranged such that during burning they coalesce into one passageway at least at the lighting end.

4. The smoking article of claims 1, 2, or 3, wherein the fuel element is less than 30 mm in length prior to smoking.

5. The smoking article of claim 4, wherein the fuel element and the aerosol generating means are in a conductive heat exchange relationship.

6. An elongated smoking article comprising:

(a) a combustible fuel element less than about 8 mm in diameter and less than about 30 mm in length, prior to smoking, having a plurality of longitudinal passageways at least partially therethrough; and (b) a physically separate aerosol generating means including an aerosol forming material.

7. An elongated smoking article comprising:

(a) a combustible fuel element less than about 30 mm in length, prior to smoking, having a plurality of longitudinal passageways at least partially therethrough;

(b) a physically separate aerosol generating means including an aerosol forming material; and (c) a resilient insulating member surrounding at least a portion of the fuel element.

8. The smoking article of claim 1, 2, 3, 6, or 7, wherein the fuel element is less than 15 mm in length prior to smoking.

9. The smoking article of claim 6 or 7, wherein the fuel element has at least three passageways.

10. The smoking article of claim 9, wherein the fuel element comprises a carbon-containing material.

11. The smoking article of claim 6 or 7, wherein the fuel element has at least seven passageways.

12. The smoking article of claim 6 or 7, wherein the fuel element has at least nine passageways.

13. The smoking article of claim 6 or 7, wherein the fuel element passageways are arranged such that during burning they coalesce into one passageway at least at the lighting end.

14. The smoking article of claim 13, wherein the fuel element comprises a carbon-containing material.

15. The smoking article of claim 6 or 7, wherein the fuel element passageways mate with a cavity in the mouth end of the fuel element.

16. The smoking article of claim 1, 2, 3, 6, or 7, which article delivers at least about 0.6 mg of wet total particulate matter in the first three puffs under FTC smoking conditions.

17. The smoking article of claim 1, 2, 3, 6, or 7, which article delivers an average of at least about 0.8 mg of wet total particulate matter per puff for at least six puffs under FTC smoking conditions.

18. An elongated smoking article comprising:

(a) a fuel element less than 30 mm in length prior to smoking having a plurality of longitudinal passageways at least partially therethrough;

(b) a physically separate aerosol generating means including a carrier bearing an aerosol forming material;

(c) means for conducting heat from the fuel element to the aerosol generating means; and (d) an insulating member which surrounds at least a portion of the fuel element.

19. The smoking article of claim 18, wherein the fuel element comprises a carbon-containing material.

20. The smoking article of claim 19, wherein the fuel element is less than 15 mm in length.

21. The smoking article of claim 18, wherein the fuel element is carbonaceous.

22. The smoking article of claim 21, wherein the fuel element is less than 15 mm in length.

23. The smoking article of claim 18, 19, 20, 21, or 22, wherein the means for conducting heat from the fuel element to the aerosol generating means is a heat conducting member recessed from the lighting end of the fuel element.

24. The smoking article of claim 18, 19, 20, 21, or 22, wherein the fuel element has at least five passageways.

25. The smoking article of claim 18, 19, 20, 21, or 22, wherein the fuel element has at least seven passageways.

26. The smoking article of claim 18, 19, 20, 21, or 22, wherein the fuel element has at least nine passageways.

27. The smoking article of claim 18, 19, 20, 21, or 22, wherein the fuel element passageways are arranged such that during burning they coalesce into one passageway at least at the lighting end.

28. The smoking article of claim 18, 19, 20, 21, or 22, wherein the fuel element passageways mate with a cavity in the mouth end of the fuel element.

29. The smoking article of claim 18, 19, 20, 21, or 22, which article delivers an average of at least about 0.8 mg of wet total particulate matter per puff for at least six puffs under FTC smoking conditions.

30. A cigarette-type smoking article comprising:

(a) a fuel element;

(b) a physically separate aerosol generating means including at least one aerosol forming material;

(c) an air permeable layer of insulating material which circumscribes at least a portion of the fuel element; and (d) a wrapper encircling at least a portion of the insulating layer, which wrapper remains at least partially intact during burning of the fuel element to restrict air flow to the burning fuel element.

31. The smoking article of claim 30, wherein the wrapper comprises a non-combustible inorganic material.

32. The smoking article of claim 30, wherein the wrapper comprises mica paper with a plurality of holes therein.

33. The smoking article of claim 30, 31, or 32, wherein the wrapper comprises a permeable sheet material which, during burning of the fuel element, helps to control the temperature at which the fuel element burns.

34. The smoking article of claim 30, 31, or 32, wherein the fuel element is a carbonaceous fuel element having a plurality of longitudinal passageways at least partially therethrough.

35. An improved wrapper for a smoking article having a combustible fuel element encircled by an air permeable insulating layer and a physically separate aerosol generating means including at least one aerosol forming material, the wrapper encircling at least a portion of the insulating layer, which wrapper remains at least partially intact during burning of the fuel element to restrict air flow to the burning fuel element.

36. The wrapper of claim 35, wherein the wrapper comprises a non-combustible inorganic material.

37. The wrapper of claim 35, wherein the wrapper comprises mica paper with a plurality of holes therein.

38. The wrapper of claim 35, 36 or 37, wherein the wrapper comprises a permeable sheet material which, during burning of the fuel element, helps to control the temperature at which the fuel element burns.

39. The smoking article of claim 1, 6, 7, 18 or 30, further comprising a mass of tobacco which is physically separate from the fuel element.

40. The smoking article of claim 1, 7, 18 or 30, wherein the fuel element is less than about 8 mm in diameter.

* * * * *

UNITED STATES PATENT AND TRADEMARK OFFICE

CERTIFICATE OF CORRECTION

PATENT NO. : 5,020,548

DATED : June 4, 1991

INVENTOR(S) : Ernest G. Farrier et al

It is certified that error appears in the above-indentified patent and that said Letters Patent is hereby corrected as shown below:

On the title page: Item [75] Inventors: add "Russell D. Barnes of Belews Creek, NC" --.

Item [56] Reference Cited

"1,259,181 3/1925 Holmes" should be --1,529,181 3/1925 Holmes--.

"3,220,418 11/1963 Cohn" should be --3,220,418 11/1965 Cohn--.

"3,223,090 12/1963 Strubel" should be --3,223,090 9/1963 Strubel--.

"3,258,015 6/1965 Ellis" should be --3,258,015 6/1966 Ellis--.

"4,284,089 8/1980 Ray" should be --4,284,089 8/1981 Ray--.

"4,437,855 9/1984 Lanzillotti" should be 4,437,855 9/1982 Lanzillotti--.

Item [56] Other Publications: add -- Copy of newspaper article from the Beaver County Times --.
Col. 19, line 8, "106" should be --$10^6$--.

Signed and Sealed this

Eighth Day of February, 1994

Bruce Lehman

*Attest:*

BRUCE LEHMAN

*Attesting Officer*

*Commissioner of Patents and Trademarks*